United States Patent [19]

Hart

[11] Patent Number: 4,879,767

[45] Date of Patent: Nov. 14, 1989

[54] DRESSES FOR WOMEN

[76] Inventor: Diane Hart, Flat 10, 156 Southerland Avenue, London W9 1HP, United Kingdom

[21] Appl. No.: 120,136

[22] Filed: Nov. 13, 1987

[30] Foreign Application Priority Data

Nov. 14, 1986 [GB] United Kingdom ..... 8627277

[51] Int. Cl.[4] ..... A41D 27/00

[52] U.S. Cl. ..... 2/243 B; 2/105

[58] Field of Search ..... 2/105, 74, 69, 243 B; 33/17 A, 17 R

[56] References Cited

U.S. PATENT DOCUMENTS

| | | | |
|---|---|---|---|
| 2,033,176 | 3/1936 | Bonanno | 2/243 B X |
| 3,609,766 | 10/1971 | Olive | 2/243 B X |
| 4,293,959 | 10/1981 | Gioello | 2/243 B |

FOREIGN PATENT DOCUMENTS

| | | | |
|---|---|---|---|
| 2002618 | 3/1971 | Fed. Rep. of Germany | 2/243 B |
| 746921 | 3/1956 | United Kingdom | 2/243 B |
| 976307 | 3/1963 | United Kingdom . | |
| 1237418 | 6/1971 | United Kingdom | 2/243 B |
| 2132383 | 7/1984 | United Kingdom | 2/243 B |

*Primary Examiner*—Werner H. Schroeder
*Assistant Examiner*—Jeanette E. Chapman
*Attorney, Agent, or Firm*—Browdy & Neimark

[57] ABSTRACT

A method of making a dress for a woman involves obtaining from a prospective wearer certain circumferential and longitudinal measurements, the latter including lengths from the shoulder to the waist at the rear, from the shoulder to the waist over the bust, from the waist to the floor and from the waist to a chosen hem level and also, preferably, from the underbust to the waist. Panels of the dress are provided each in several sizes, the panels being formed from block patterns thereof, each panel having a circumferentially extending edge spaced significantly from the waist level of the finished dress. The measurements taken are employed to select the panels of the dress to be made each in desired size and the selected panels are thereafter formed into a dress by seaming together thereof.

13 Claims, 2 Drawing Sheets

DRESSES FOR WOMEN

BACKGROUND OF THE INVENTION

1. Field of the Invention

This invention relates to a method of making dresses for women.

In United Kingdom Specification No. 976,307, there is described a method of making foundation garments for women, that is to say skin fitting, body moulding garments. That method does not lend itself to the making of dresses which, in general, are not skin fitting and require to hang on the wearer in stylish and attractive manner. Indeed were dress making attempted by the method of the patent referred to it would be very difficult to produce a garment which flattered the wearer inasmuch as such garment would be required to be close fitting at the waist. The "little black dress" as it is widely referred to and which is not necessarily "black", is a garment which is much sought after because of its suitability for wear on a wide range of occasions. Stocks of such dresses held by retailers are limited and women frequently encounter great difficulty in getting themselves suited when seeking such a dress.

It is accordingly one object of this invention to provide a method of making dresses for women in a large variety of styles. It is a further object to enable attractively fitting dresses to be made from a few measurements of the users and a few details of style required, the measurements and style details being, for example, forwarded by mail order.

The present invention consists in a method of making a dress for a woman comprising by the steps of obtaining from a prospective wearer of said dress circumferential vertically spaced measurements at levels of the bust, the waist and the hips and longitudinal measurements taken from the shoulder to the waist at the rear from the shoulder to the waist over the bust, from the waist to the underbust level, from the waist to the floor and from the waist to a chosen hem level, providing pre-cut panels of from said measurements of prospective wearers dress to be made in a plurality of basic sizes, each basic size being furnished as a plurality of panels of varied lengths and widths and each panel having a circumferentially extending edge for seaming to a corresponding circumferentially extending edge of an adjacent panel which is disposed at a significant spacing from the waist level, utilizing the measurements obtained from a prospective wearer to select for the dress to be made from said panels provided, panels in the correct basic size and of width and length best suited to said obtained measurements, and seaming together said selected panels to form a dress in accordance with said obtained measurements.

Suitably the method of the invention includes utilising at least one of said circumferential and one of said longitudinal measurements to determine the size of each panel of the dress.

Advantageously said longitudinal measurements include a length from waist level to under bust level of the prospective wearer.

In a preferred embodiment each panel has a circumferentially extending edge disposed in the finished dress at the same vertical level and in the range 2" to 5" below the waist.

Preferably, the circumferential measurements include a bust and an underbust measurement and a waist and a hip measurement. Preferably, also, the circumferential measurements include a measurement taken in the range of 2" to 5" below the waist level.

Suitably, the measurements taken are utilised to determine the sizes of three panels comprising the skirt and of three panels forming the bodice part of the dress formed by employing said measurements.

Advantageously, the skirt of the dress is formed from a central front panel and two further panels respectively extending from seams at the upright sides of the central front panel to a centre upright seam at the rear of the skirt. Suitably, the bodice of the dress is formed from a central front panel and two further panels each extending from a shoulder seam and corresponding side seam of the central front panel to an upright centre seam at the rear of the bodice. Suitably, access means such as a sliding clasp fastener are provided in the centre rear or side seam of the bodice and/or the skirt.

BRIEF DESCRIPTION OF THE DRAWINGS

The invention will now be described, by way of example, with reference to the accompanying diagrammatic drawings, in which.

DETAILED DESCRIPTION OF THE PREFERRED EMBODIMENT

Figure 1:
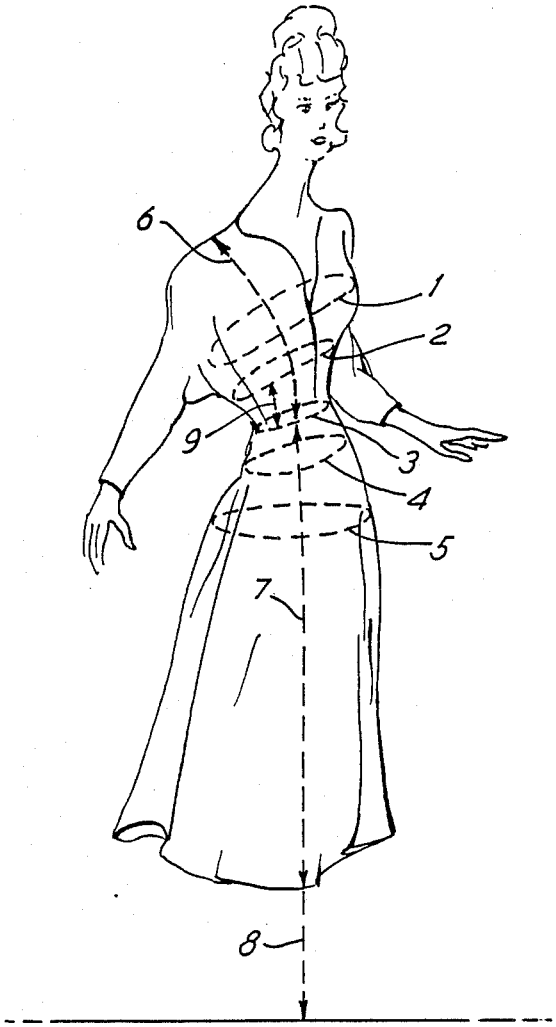
FIG. 1 is a diagrammatic view illustrating measurements of the female figure which it is required to take in order to carry out the method of the present invention.

Referring first to FIG. 1, the required measurements to make a dress according to the method of the invention comprise circumferential and longitudinal measurements. The circumferential measurements 1,2,3,4 and 5 are taken at vertically spaced intervals and comprise the bust, underbust, waist, 4" below the waist and the hip measurements respectively. The hip measurement is usually taken at a level about 7" below the waist measurement level. The longitudinal measurements comprise a measurement 6 from the centre of the shoulder over the bust to the waist, a measurement 7 from the waist to the skirt hem, a measurement 8 from the waist to the floor, a measurement, not shown, from the centre of the shoulder to the waist at the rear of the person being measured and, a measurement 9 from the underbust to the waist level.

Those skilled in the art will appreciate that the basic bodice size is determined by the overbust and underbust measurement and the basic skirt size by the hip measurement.

Figure 2:
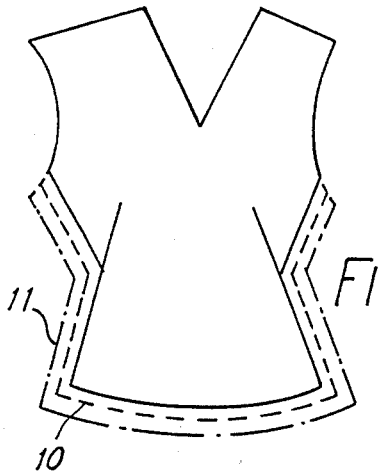
FIG. 2 illustrates a block pattern of a front panel of a garment bodice which variants illustrated in broken lines.
Figure 3:
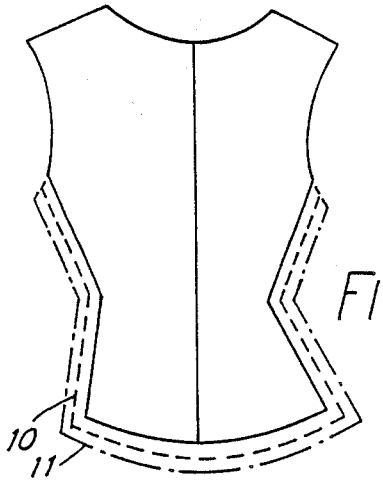
FIG. 3 illustrates a block pattern of two rear panels of said garment bodice which panels are united by a centre vertical seam, the broken and chain dotted lines representing variants of said block pattern.
Figure 5:
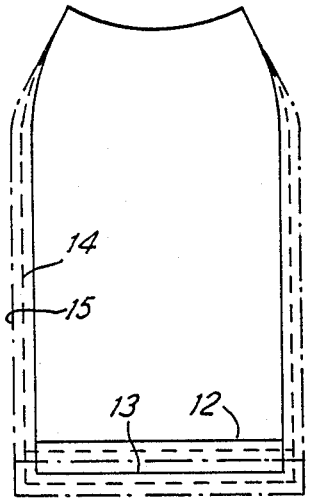
FIG. 5 illustrates a block pattern in two different lengths with variants thereof in broken and chain dotted lines of a front panel of a garment skirt, and, FIG. 6 shows block patterns of left and right rear panels of said garment skirt each with variants shown in broken and chain dotted lines.
Figure 6:
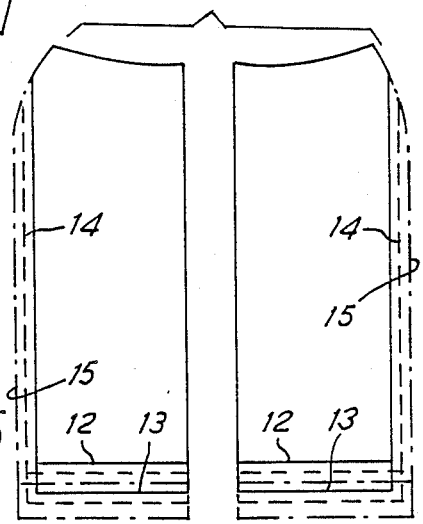

In each of FIGS. 2 and 3 are illustrated block patterns for a basic bodice size determined by the underbust measurement. Such block patterns are available for each basic bodice size and each block pattern is provided with a number of variants two of which are indicated by broken lines 10 and chain dotted lines 11. In practice, more variants of each block pattern are provided than are shown in the drawings. The circumferential measurements 1,2,3 and 4 and the vertical measurements from the shoulder to the waist at the rear and from the shoulder over the bust to the waist and from the underbust to waist enable the dressmaker to determine the basic block patterns for the front and rear panels of the bodice and the variants thereof uniquely suited to the specific measurements taken. Similarly, FIGS. 5 and 6 show the basic block patterns in a choice of two basic lengths 12 and 13 of the garment skirt front panel (FIG. 5) and of left and right rear skirt panels (FIG. 6). Each block pattern has a number of variants two of which are diagrammatically illustrated by broken lines 14 and chain dotted lines 15 in FIGS. 5 and 6 though, in practice, each basic block pattern has more associated variants than are illustrated in the drawings. The hip measurements determine the basic block pattern to be used for the skirt panels, there being a number of such basic block patterns for different hip measurements. The waist to hip measurement determines the basic length of the selected block pattern which is appropriate. The waist measurement and the waist to floor measurements determine which of the block pattern variants is best suited to the individual collection of measurements taken.

When the customer's measurements are supplied, there are also supplied a number of other details which determine the style of the dress to be made. Thus, when the dress is to have sleeves, the desired sleeve length, full, short or three-quarter, is supplied as is the sleeve style, puff, raglan etc.

Figure 4:
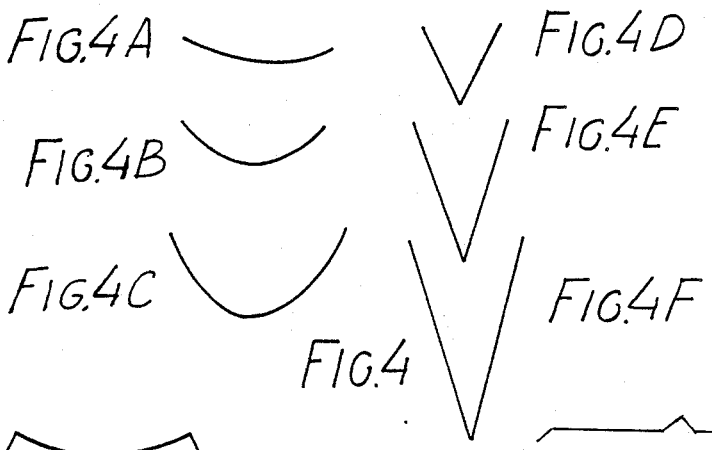
FIGS. 4A, 4B, 4C, 4D, 4E and 4F show a choice of necklines available each for either or both the front and rear bodice panels of the garment.

Similarly, the desired neckline, front and rear, is chosen from a number of possible variants some of which are shown in FIG. 4. Also, the skirt block patterns can be provided to enable a skirt with a slit in one or both side seams or a gusset in those seams to be formed, the seam gussets imparting flair to the finished skirt. Skirt block patterns may also be provided to enable dresses to be made from the measurements supplied with wrap-over, flared, bubble etc. skirts. Likewise, bodice block patterns may be provided to enable bodice variants such as no neck, wrap-over etc., to be provided in the finished dress.

The dress corresponding to the measurements taken is formed by seaming the selected panels together, the bodice panels having been chosen with the desired neckline and the skirt panels having been chosen with the required length and to enable other features such as slits or gussets to be incorporated. Sleeves of the requisite style are also incorporated when the dress is made up from its component parts. Also, access means such as a sliding clasp fastener can be incorporated in the skirt and bodice side or rear seam during seaming together of the selected panels. It should be noted that the difference in level between the underbust and waist tells the dressmaker whether the person measured is long or short waisted and these measurements together with the waist to floor measurement 8 supply most of the information needed by the dressmaker to ascertain the overall form of the person measured excluding bust size.

An important feature of the described embodiment of the invention is that the block patterns are all provided in a form such that the dress panels made therefrom include an edge at the level of measurement 4 which is preferably four inches below the waist level but it may be anything from two to five inches below that level. It has been found that this feature provides dresses which are far better accommodated to the dimensions of the wearer than if the panels all had an edge at waist level and are therefore more flattering to the wearer. It has further been found that the invention can also be applied to produce dresses which hang satisfactorily on and flatter the wearer more than if the block patterns are all provided in a form such that the panels made therefrom each include an edge equally but significantly spaced above, instead of below, the waist of the wearer but located below the underbust. For the most satisfactory results the said edges of the panels above the waist level are disposed in the range 2 to 4.5 inches above waist level.

As earlier intimated, the customer can be solicited by mail order and take or have taken her own measurements which are then sent through the post to the manufacturer. Instead of having skilled personnel to interpret the measurements and choose the optimum dress panels therefrom, the selection of panels can be effected by a computer programmed to select the requisite panels from sets of measurements supplied to it. The selection can be automated so that the computer when supplied with measurement data of a customer, selects the relevant panels from stocks of each panel held in a store. If the customer is required to purchase her garment at a retail outlet, the computer can be programmed to screen the form of dress style chosen by the purchaser who can then change specific features until there is displayed on a visual display unit, a style with which the customer is content.

I claim:

1. A method of making a dress for a woman comprising the steps of:

(a) obtaining from a prospective wearer of said dress circumferential vertically spaced measurements at levels of the bust, the waist and the hips and longitudinal measurements taken from the shoulder to the waist at the rear, from the shoulder to the waist over the bust, from the waist to the underbust level, from the waist to the floor and from the waist to a chosen hem level;

(b) providing pre-cut panels of dresses to be made from said measurements of prospective wearers in a plurality of basic sizes, each basic size being furnished as a plurality of panels of varied lengths and widths and each panel having an edge extending parallel with waist level for seaming to a corresponding edge extending parallel with waist level of an adjacent panel which is disposed at a significant spacing from waist level;

(c) utilising said measurements obtained from a prospective wearer to select for the dress to be made from said panels provided, panels in the correct basic size and of width and length best suited to said obtained measurements; and (d) seaming together said selected panels to form a dress in accordance with said obtained measurements.

2. The method of claim 1, further comprising the step of utilizing at least one of said circumferential measurements and one of said longitudinal measurements to determine the size of each panel of the dress.

3. The method claimed in claim 1, further comprising the step of providing that the significant spacing from waist level for the edges which extend parallel to waist level of the respective panels disposed in a finished dress incorporating said panels is a spacing which is the same distance from the waist in the range of 2" to 5" below the waist.

4. The method claimed in claim 3, further comprising the step of taking a circumferential measurement of said prospective wearer of the dress in the range of 2" to 5" below the waist level.

5. The method claimed in claim 1, further comprising the step of providing that the significant spacing from waist level for the edges which extend parallel to waist level of the respective panels disposed in a finished dress incorporating said panels is a spacing which is the same distance from the waist in the range of 2" to 4.5" above the waist.

6. The method claimed in claim 1, further comprising the step of taking from the prospective wearer circumferential measurement at the level of the underbust.

7. The method claimed in claim 1, further comprising providing that a skirt of the dress is formed from a central front panel and two further panels respectively extending from seams at upright sides of the central front panel to a centre upright seam at a rear of the skirt.

8. The method claimed in claim 1, further comprising providing that the bodice of the dress is formed from a central front panel and two further panels each extending from a shoulder seam and corresponding side seam of a central front panel to an upright centre seam at the rear of the bodice.

9. The method claimed in claim 7, further comprising providing access means in the centre rear or side seam of the skirt and/or bodice.

10. The method claimed in claim 2, further comprising the step of providing that the significant spacing from waist level for the edges which extend parallel to waist level of the respective panels disposed in a finished dress incorporating said panels is a spacing which is the same distance from the waist in the range of 2" to 5" below the waist.

11. The method claimed in claim 1, further comprising taking a circumferential measurement of said prospective wearer of the dress in the range of 2" to 5" below the waist level.

12. The method claimed in claim 2, further comprising the step of providing that the significant spacing from waist level for the edges which extend parallel to waist level of the respective panels disposed in a finished dress incorporating said panels is a spacing which is the same distance from the waist in the range of 2" to 4.5" above the waist.

13. The method claimed in claim 8 further comprising providing access means in the centre rear or side seam of the skirt and/or bodice.

* * * * *